US005989976A

United States Patent [19]

Liao

[11] Patent Number: 5,989,976

[45] Date of Patent: Nov. 23, 1999

[54] FABRICATION METHOD FOR A FIELD EMISSION DISPLAY EMITTER

[75] Inventor: Kuan-Yang Liao, Taipei, Taiwan

[73] Assignee: United Silicon Incorporated, Hsinchu, Taiwan

[21] Appl. No.: 09/122,618

[22] Filed: Jul. 22, 1998

[30] Foreign Application Priority Data

Jun. 10, 1998 [TW] Taiwan ..... 87109217

[51] Int. Cl.[6] ..... H01J 1/30

[52] U.S. Cl. ..... 438/424; 514/700

[58] Field of Search ..... 438/345, 700, 438/424, 514

[56] References Cited

U.S. PATENT DOCUMENTS 5,160,492 11/1992 Wang et al. ..... 438/43

5,783,905 7/1998 Greschner et al. ..... 313/497

*Primary Examiner*—Benjamin Utech
*Assistant Examiner*—Lynette T. Umez-Eronini
*Attorney, Agent, or Firm*—Thomas, Kayden, Horstemeyer & Risley

[57] ABSTRACT

A fabrication method for a sharp tip emitter first includes a trench formed on a semiconductor substrate. Next, an isolating layer is deposited over the substrate by high-density plasma chemical vapor deposition (HDP CVD). A V-shaped groove is naturally formed on the isolating layer around the trench. Next, a silicon layer is formed over the isolating layer and an ion implantation is performed into the silicon layer over the V-shaped groove. Next, a semiconductor layer is formed over the substrate. Next, a high temperature thermal process is performed to drive the implanted ions into the semiconductor layer. Next, the isolating layer is removed so that the silicon layer is separated from the substrate. Then, the tip emitter is formed.

19 Claims, 7 Drawing Sheets

FABRICATION METHOD FOR A FIELD EMISSION DISPLAY EMITTER

CROSS-REFERENCE TO RELATED APPLICATION

This application claims the priority benefit of Taiwan application serial no. 87109217, filed Jun. 10, 1998.

BACKGROUND OF THE INVENTION

1. Field of the Invention:

This invention relates to a fabrication method for a field emission display (FED) emitter, and more particularly to a fabrication method by photolithography and etching for a FED emitter.

2. Description of Related Art:

Currently, flat panel display technology includes cathode ray tube (CRT), thin film transistor liquid crystal display (TFTLCD), plasma display panel (PDP), and FED, some of which have been successfully applied in the market. The FED is expected to be one of the more strongly competitive displays used in the $21^{st}$ century. The FED is composed of a pair of upper and lower plates. A number of spacers are located in between the upper plate and the lower plate. The upper plate, serving as an anode plate, usually is a glass plate coated with a phosphorus material. The lower plate, serving as a cathode plate, is usually a field emission array (FEA), which can emit an electron beam. A gate between the anode plate and the cathode plate regulates the flux of the electron beam. When emitted electrons pass the gate, they are accelerated by the electric field in order to gain enough energy to hit the phosphorus material. A catho-luminescent phenomenon results.

The FEA applied in current FEDs is basically a type of tip emitter or thin film edge emitter. The array is composed of a number of pixels in a matrix structure; each pixel has its own matrix address. Every pixel further includes several hundred spikes or thin film edges. The spike root is about 1 micron and the tip of the spike has a radius of about less than 0.1 micron. The spikes are made of metal, such as molybdenum (Mo), tungsten (W), or platinum (Pt), or a semiconductor material, such as silicon or diamond.

FIGS. 1A–1C are cross sectional views schematically illustrating the fabrication flow of a conventional tip emitter using metal material.

Referring to FIGS. 1A–1C, an oxide layer 102 is formed over a substrate 100, and a photoresist layer 104, with an opening, is formed over the oxide layer 102. A groove 106 corresponding to the opening of the photoresist layer 104 is formed on the oxide layer 102 through isotropic etching. The groove 106 exposes the substrate 100. The isotropic etching includes wet etching using, for example, a HF acid solution. Due to the isotropic etching, the groove 106 has a wider aperture than the opening of the photoresist layer 104 so that the photoresist layer 104 around the opening region overhangs a portion of the groove 106. In this structure, after a metal, such as Mo, W, or Pt, is sputtered on the substrate, a spike 108 with sharp tip is formed on the substrate. This is called a shading effect. After sequentially removing the photoresist 104 and the oxide layer 102, only the spike 108 remains on the substrate 100.

FIGS. 2A–2C are cross sectional views schematically illustrating the fabrication flow of a conventional tip emitter using silicon.

Referring to FIGS. 2A–2C, a photoresist layer 202 with an opening is formed over a silicon substrate 200. Usingi the photoresist layer 202 as an etching mask, the silicon substrate 200 is etched to form a V-shaped groove 204, in which the V-shape is formed due to the properties of the silicon material. After removing the photoresist layer 202, an oxide layer 206 is formed over the substrate. Then, a silicon layer 208 is deposited over the oxide layer 206 which also fills the V-shape groove 204. After removing the oxide layer 206, the silicon layer 208 is separated from the silicon substrate 200. The silicon layer 208 therefore carries a triangle spike 208*a*, which is conformal with the V-shape groove 204.

SUMMARY OF THE INVENTION

It is therefore an objective of the present invention to provide a fabrication method of a tip emitter to be applied in field emission displays (FED), in which the tip emitter includes a uniform silicon sharp tip to emit electrons. The fabrication method of the invention produces a tip emitter with a higher density of field emission array (FEA) and a better conductivity resulting from a high temperature thermal process.

In accordance with the foregoing and other objectives of the present invention, the fabrication method of a uniform sharp tip emitter first includes a trench formed on a semiconductor substrate. Next, an isolating layer is deposited over the substrate through high-density plasma chemical vapor deposition (UDP CVD). The isolating layer non-uniformly covers the substrate without exposing it. Because of the properties of HDP, a V-shaped groove is naturally formed on the isolating layer around the trench. The acute V-shaped bottom is located within the trench. Next, a silicon layer is formed over the isolating layer and an ion implantation is performed onto the silicon layer over the V-shape groove. Next, a semiconductor layer is formed over the substrate. Next, a high temperature thermal process is performed to drive the implanted ions into the semiconductor layer. Next, the isolating layer is removed so that the silicon layer is separated from the substrate. The silicon layer together with the semiconductor layer form a uniform sharp tip emitter, in which the sharp tip is conformal with the acute V-shaped bottom and emits electrons.

BRIEF DESCRIPTION OF DRAWINGS

The invention can be more fully understood by reading the following detailed description of the preferred embodiment, with reference made to the accompanying drawings as follows.

DETAILED DESCRIPTION OF PREFERRED EMBODIMENT

EXAMPLE 1

FIGS. 3A–3G are cross sectional views schematically illustrating the fabrication flow of a tip emitter according to a first preferred embodiment of the invention.

Figure 1A:
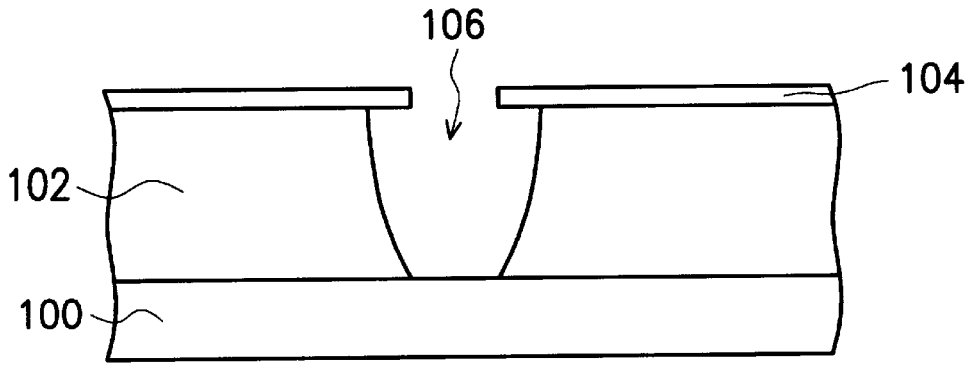
FIG. 1A (PRIOR ART)
FIGS. 1A–1C are cross sectional views schematically illustrating the fabrication flow of a conventional tip emitter using metal.
Figure 1B:
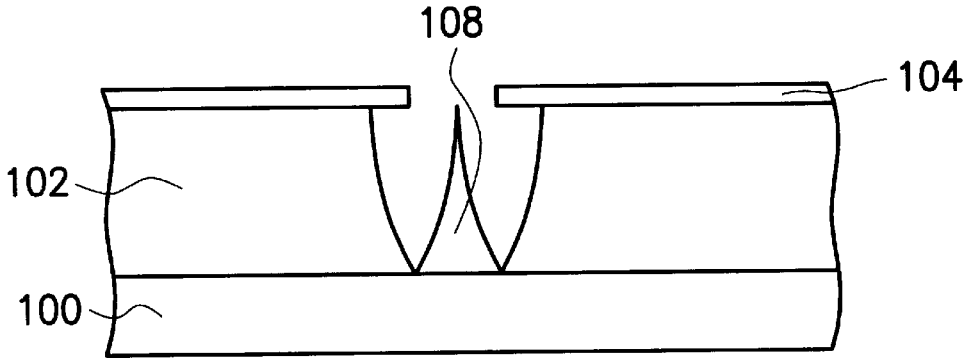
FIG. 1B (PRIOR ART)
Figure 1C:
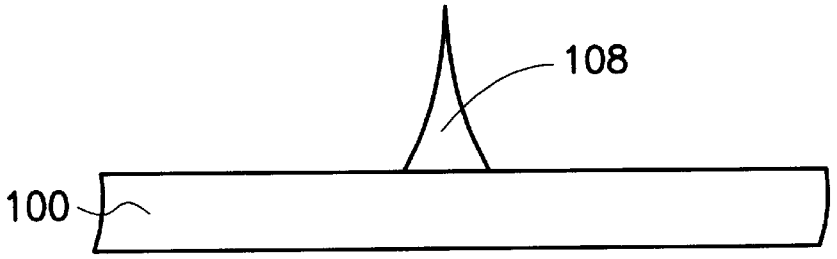
FIG. 1C (PRIOR ART)
Figure 2A:
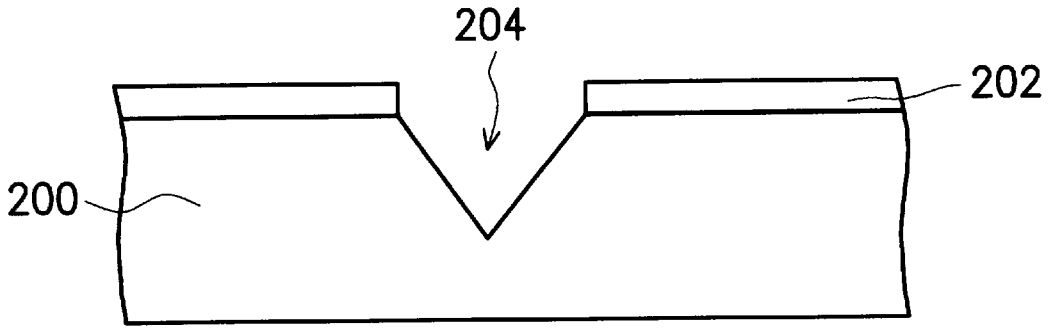
FIG. 2A(PRIOR ART)
FIGS. 2A–2C are cross sectional views schematically illustrating the fabrication flow of a conventional tip emitter using silicon.
Figure 2B:
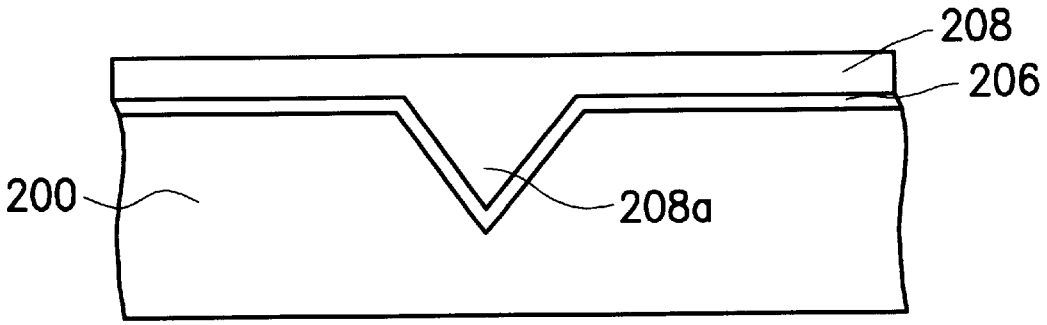
FIG. 2B(PRIOR ART)
Figure 2C:
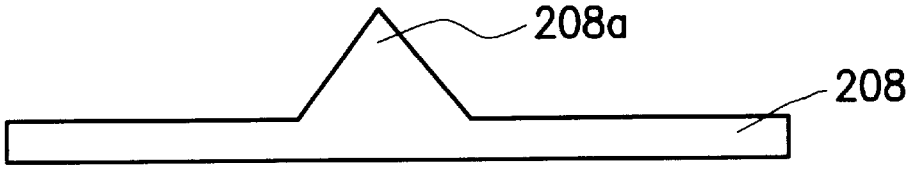
FIG. 2C(PRIOR ART)
Figure 3A:
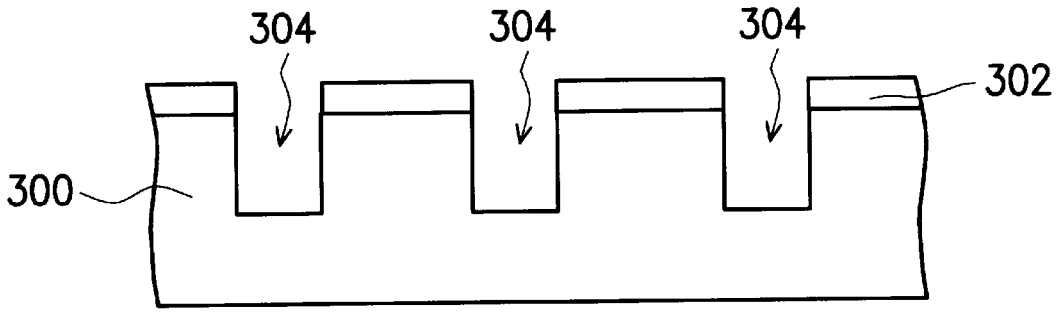
FIGS. 3A–3G are cross sectional views schematically illustrating the fabrication flow of a tip emitter according to a first preferred embodiment of the invention.

Referring to FIG. 3A, a photoresist layer 302 is used to pattern a semiconductor substrate 300 to form a trench 304 on it using for example, plasma etching. The semiconductor substrate 300 can be, for example, made of silicon or polysilicon.

Figure 3B:
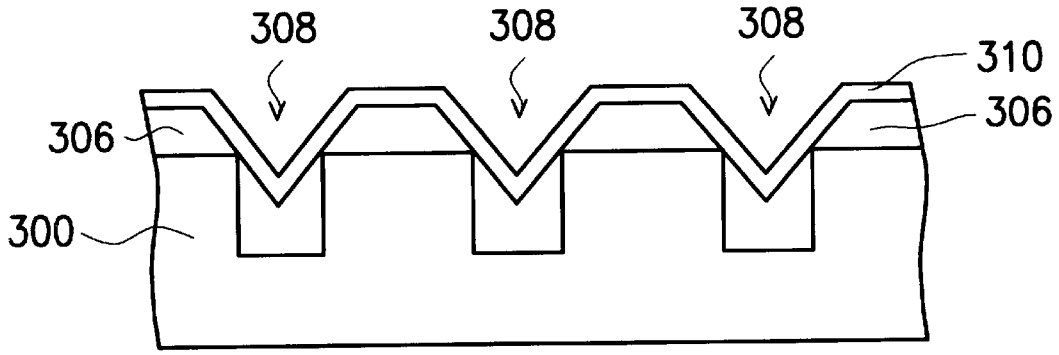

Referring to FIG. 3B, the photoresist layer 302 is removed. Next, a high-density plasma (HDP) chemical vapor deposition (CVD) process is performed to deposit an isolating, layer 306 over the substrate 300. The isolating layer 306 including, for example, oxide, non-uniformly covers the substrate 300 without exposing it. The properties of HDP naturally cause a V-shaped groove 308 to form on the isolating layer 306 around the trench 304. The acute V-shaped bottom of the groove 308 is located within the trench 304. Next, a silicon layer 310 is deposited over the isolating layer 306 by low pressure CVD (LPCVD), in which Silane ($SiH_4$) or Di-chlorosilane ($SiH_2Cl_2$) are the reaction gases.

Figure 3C:
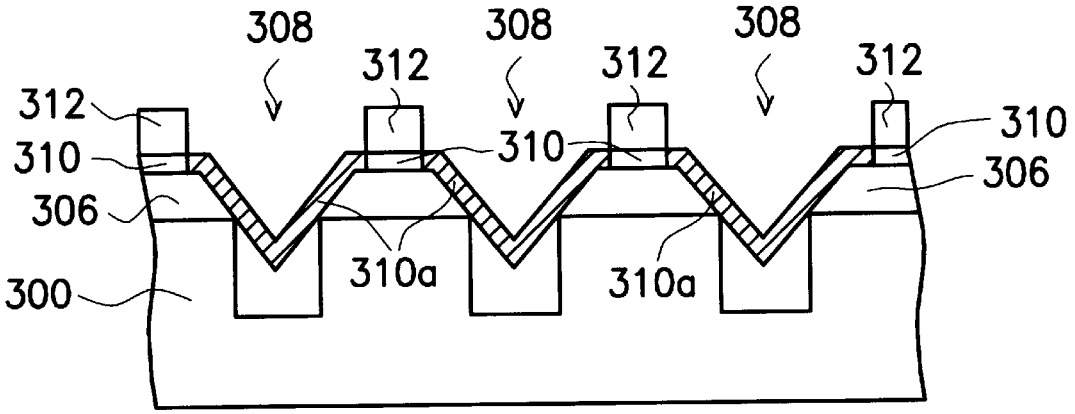
Figure 3D:
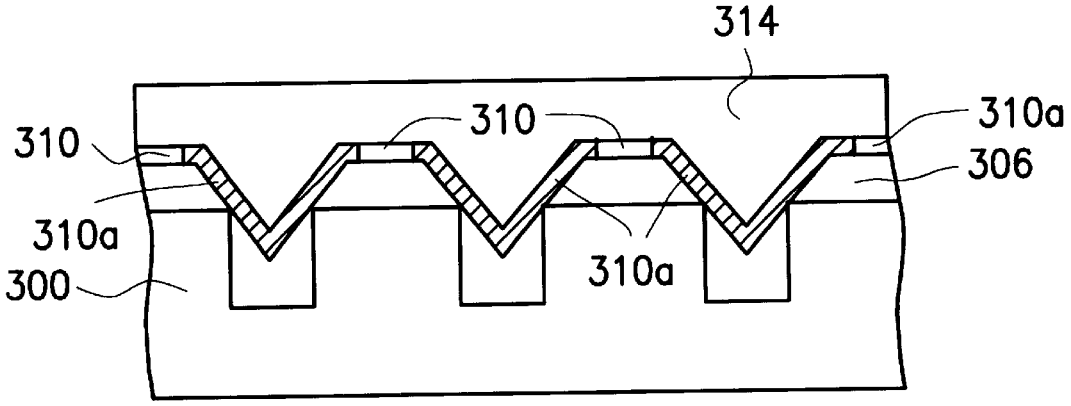

Referring, to FIG. 3C, an implantation mask 312 is formed over the flat portions of the silicon layer 310 and then an ion implantation is performed into the exposed portions of silicon layer 310. Thus, only a grooved region 310*a* of the silicon layer 310 is implanted. Referring to FIG. 3D, after removing the implantation mask 312, a semiconductor layer 314 made of, for example, polysilicon or amorphous silicon is deposited over the substrate 300, which also fills the groove 308.

Figure 3E:
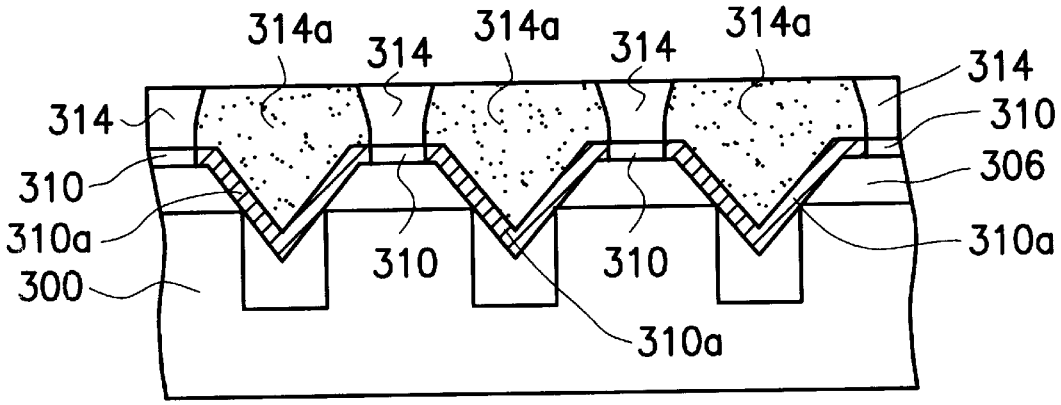

Referring to FIG. 3E, next, an annealing process with a temperature of about 1000° C. is performed to drive the implanted ions into the semiconductor layer 314 so that a doped region 314*a* is formed inside the semiconductor layer 314. The resistance at the doped region 314*a* is reduced by the processes of ion implantation and annealing. In other words, the conductivity at the doped region 314*a* is increased.

Figure 3F:
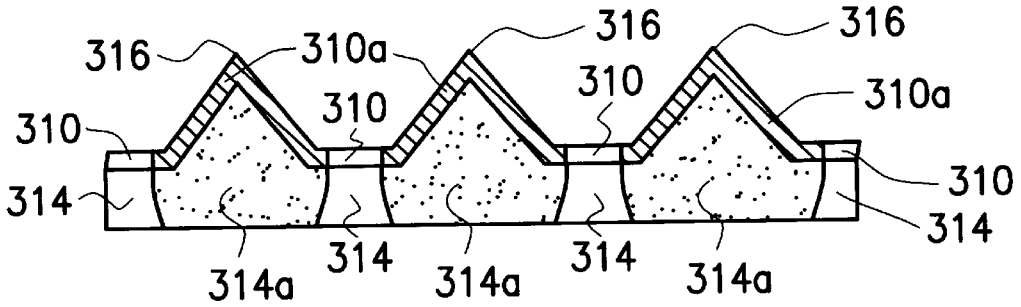
Figure 3G:
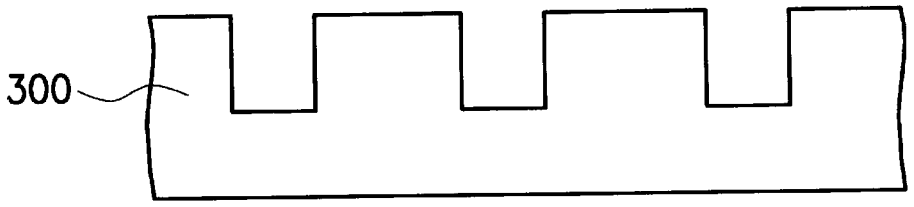

Referring to FIG. 3F and FIG. 3G, because the etching selectivity is different, it is possible to remove only the isolating layer 306 by, for example, wet etching, in which HF acid solution is used. So the silicon layer 310, including the groove region 310*a*, is separated from the silicon substrate 300. The silicon layer 310 together with the semiconductor layer 314, which includes the doped region 314*a*, form a uniform sharp tip emitter, in which a number of sharp tips 316 are conformal with the acute V-shaped bottom and emit electrons. The silicon substrate 300 as shown in FIG. 3G can be reused in the invention.

EXAMPLE 2

FIGS. 4A–4G are cross sectional views schematically illustrating the fabrication flow of a tip emitter according to a second preferred embodiment of the invention.

Figure 4A:
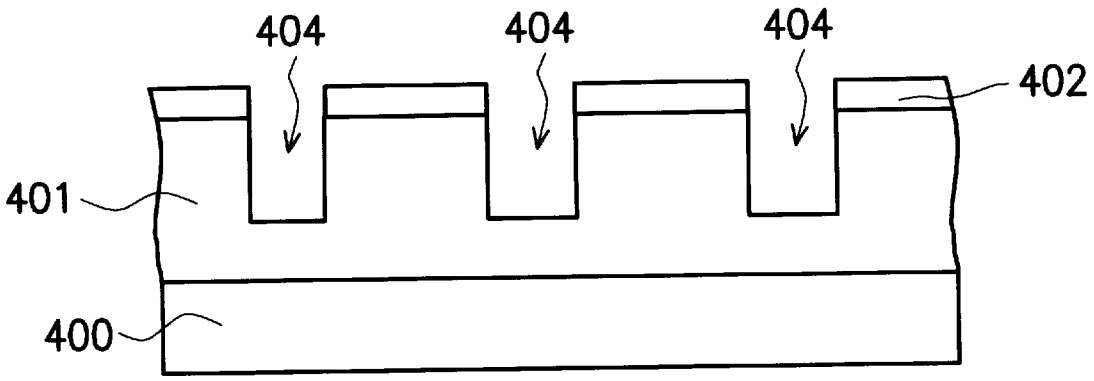
FIGS. 4A–4H are cross sectional views schematically illustrating the fabrication flow of a tip emitter according to a second preferred embodiment of the invention.

Referring to FIG. 4A. an isolating layer 401 is formed over a substrate 400. Next, a photoresist layer 402 is used to pattern the isolating layer 401 to form a trench 404 by an etching process, such as plasma etching. The substrate is made of, for example, silicon or polysilicon and the isolating layer 401 is made of a material such as oxide.

Figure 4B:
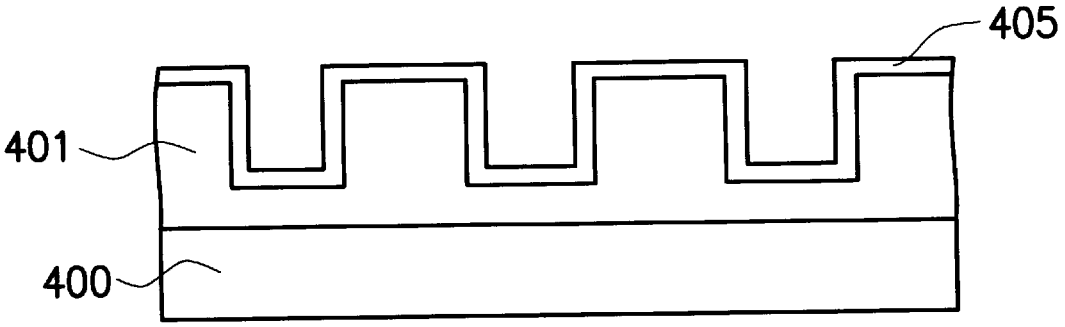

Referring to FIG. 4B, the photoresist layer 402 is removed. Next, a material layer 405 such as a silicon nitride layer 405 is formed over the isolating layer 401. The etching rate of the silicon nitride layer 405 is different from the isolating layer 401.

Figure 4C:
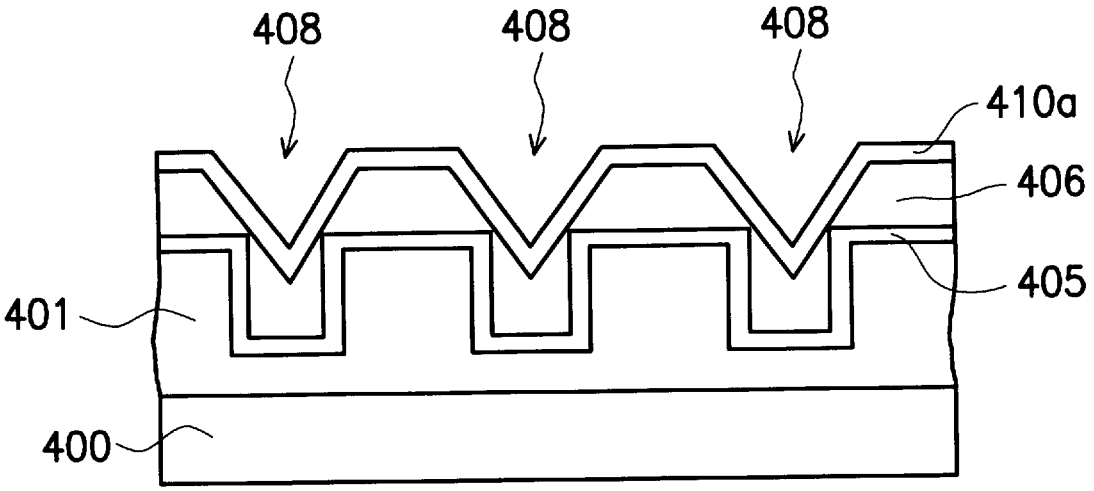

Referring to FIGS. 4A–4C, next, a high-density plasma (HDP) chemical vapor deposition (CVD) process is performed to deposit an isolating layer 406 over the substrate 400. The isolating layer 406 including, for example, oxide non-uniformly covers the substrate 400 without exposing it. The properties of HDP naturally cause a V-shaped groove 408 to form on the isolating layer 406 around the trench 404. The acute V-shaped bottom of the groove 408 is located within the trench 404. Next, a silicon layer 410 is deposited over the isolating layer 406 by low pressure CVD (LPCVD), in which Silane ($SiH_4$) or Di-chlorosilane ($SiH_2Cl_2$) are the reaction gases used.

Figure 4D:
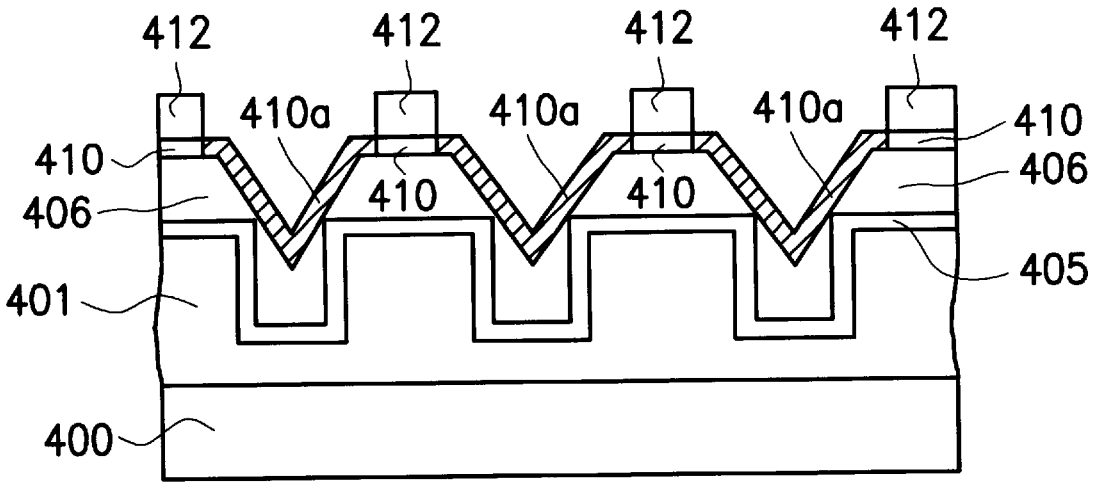
Figure 4E:
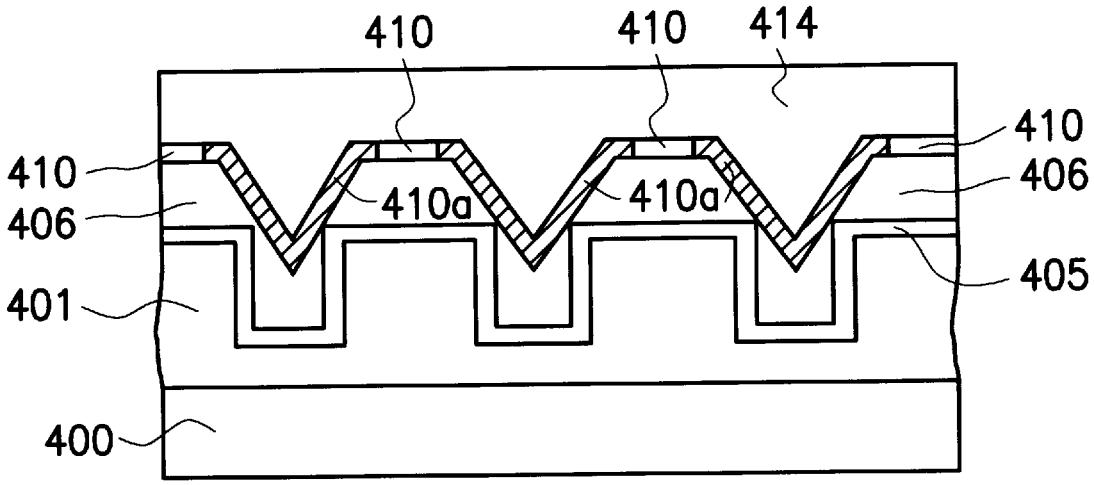

Referring to FIG. 4D, an implantation mask 412 is formed over the flat portions of the silicon layer 410 and then an ion implantation is performed into the exposed portions of silicon layer 410. Thus, only a grooved region 410*a* of the silicon layer 410 is implanted. Referring to FIG. 4E, after removing the implantation mask 412, a semiconductor layer 414 made of, for example, polysilicon or amorphous silicon is deposited over the substrate 400, which also fills the groove 408 as shown in FIG. 4C.

Figure 4F:
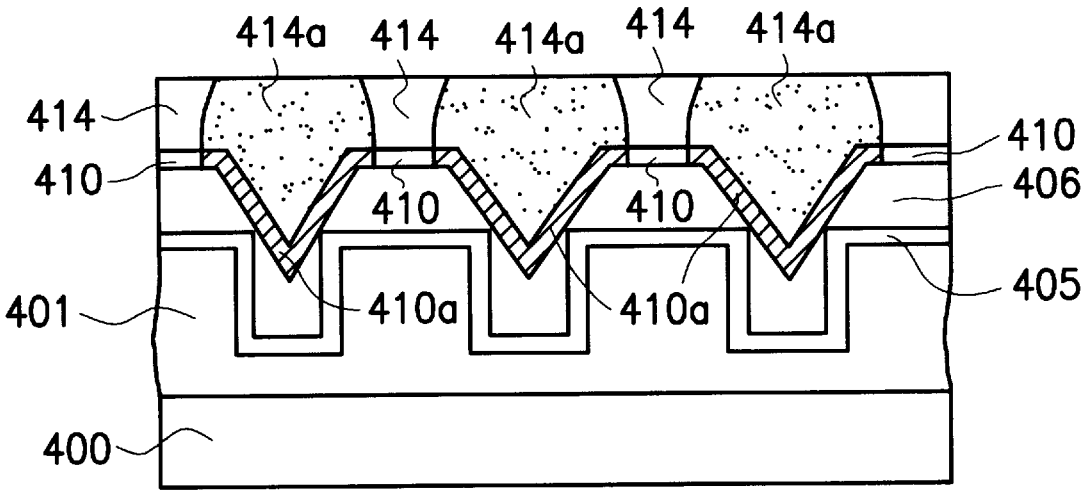

Referring to FIG. 4F, next, an annealing process with a temperature of about 1000° C. is performed to drive the implanted ions into the semiconductor layer 414 so that a doped region 414*a* is formed inside the semiconductor layer 414. The resistance at the doped region 414*a* is reduced by the processes of ion implantation and annealing. In other words, the conductivity at the doped region 414*a* is increased.

Figure 4G:
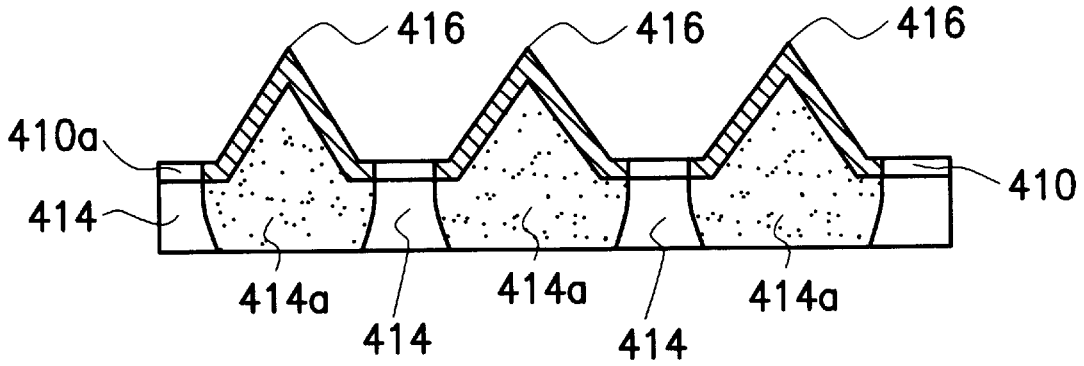
Figure 4H:
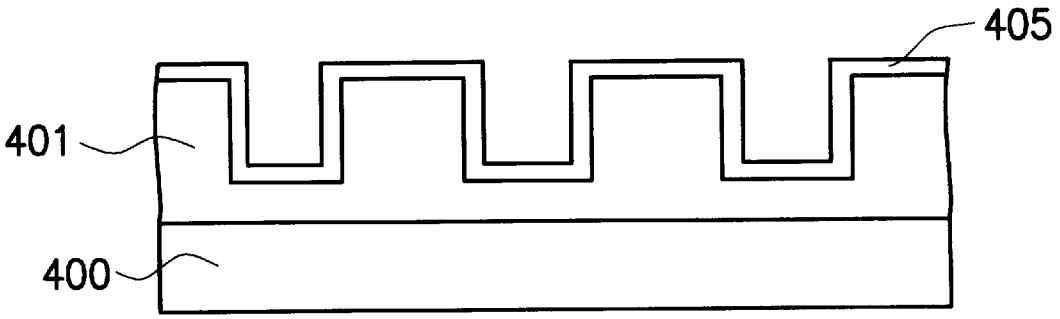

Referring to FIG. 4G and FIG. 4H, only the isolating layer 406 is removed by, for example, wet etching, in which HF acid solution is used. So the silicon layer 410 including the groove region 410*a* is separated from the silicon substrate 400. The silicon layer 410 together with the semiconductor layer 414, which includes the doped region 414*a*, form a uniform sharp tip emitter. A number of sharp tips 416 on the uniform sharp tip emitter are conformal with the acute V-shaped bottom and emit electrons. The silicon substrate 400 with the isolating layer 401, the trench, and the nitride layer 405 as shown in FIG. 4H can be reused in the invention for fabrication.

In conclusion, the tip emitter fabricated in the invention has the characteristics that the density of the field emission array (FEA) is greater than the conventional one and the conductivity resulting from a high temperature thermal process is increased.

The invention has been described using exemplary preferred embodiments. However, it is to be understood that the scope of the invention is not limited to the disclosed embodiments. On the contrary, it is intended to cover various modifications and similar arrangements. The scope of the claims, therefore, should be accorded the broadest interpretation so as to encompass all such modifications and similar arrangements.

What is claimed is:

1. A fabrication method for a tip emitter, the method comprising:

patterning a substrate to form a plurality of trenches;

performing a high-density plasma (HDP) chemical vapor deposition (CVD) to deposit an isolating layer fully covering the substrate, wherein multiple V-shaped grooves are formed corresponding to the trenches;

forming, a silicon layer over the isolating layer;

implanting ions into the V-shaped grooves;

forming a semiconductor layer over the substrate;

performing a high temperature thermal process on the substrate to drive implanted ions into the semiconductor layer; and removing the isolating, layer to separate the silicon layer from the substrate, wherein the silicon layer together with the semiconductor layer form the tip emitter comprising a plurality of sharp tips, which are conformal with the V-shaped grooves, and the substrate is reusable.

2. The method of claim 1, wherein the substrate comprises silicon.

3. The method of claim 1, wherein the substrate comprises polysilicon.

4. The method of claim 1, wherein the step of removing the isolating layer comprises wet etching.

5. The method of claim 1, wherein the high temperature thermal process comprises a temperature of about 1000° C.

6. The method of claim 1, wherein the step of forming the trenches comprises a plasma process.

7. The method of claim 1, wherein the semiconductor layer comprises polysilicon.

8. The method of claim 1, wherein the semiconductor layer comprises amorphous silicon.

9. The method of claim 1, wherein the isolating layer comprises an etching selectivity larger than the semiconductor substrate.

10. A fabrication method for a tip emitter, the method comprising:

forming a first isolating layer over a substrate;

pattering the first isolating layer to form multiple trenches;

forming a material layer over the first isolating layer, in which the material layer and the first isolating layer have different etching selectivity;

performing a which density plasma (HDP) chemical vapor deposition (CVD) process to deposit a second isolating layer fully covering the substrate, wherein multiple V-shaped grooves are formed corresponding to the trenches;

forming a silicon layer over the second isolating layer;

implanting ions onto the V-shaped grooves;

forming a semiconductor layer over the substrate;

performing a high temperature thermal process on the substrate to drive implanted ions into the semiconductor layer; and removing the second isolating layer to separate the silicon layer from the substrate, wherein the silicon layer together with the semiconductor layer form the tip emitter comprising multiple sharp tips, which are conformal with the V-shaped grooves, and the substrate is reusable.

11. The method of claim 10, wherein the substrate comprises silicon.

12. The method of claim 10, wherein the substrate comprises polysilicon.

13. The method of claim 10, wherein the step of removing the second isolating layer comprises wet etching.

14. The method of claim 10, wherein the high temperature thermal process comprises a temperature of about 1000° C.

15. The method of claim 10, wherein the step of forming the trenches comprises a plasma process.

16. The method of claim 10, wherein the semiconductor layer comprises polysilicon.

17. The method of claim 10, wherein the semiconductor layer comprises amorphous silicon.

18. The method of claim 10, wherein the second isolating layer comprises an etching selectivity larger than the substrate.

19. The method of claim 10. wherein the material layer comprises TiN.

* * * * *